United States Patent [19]

Gostelow et al.

[11] Patent Number: 4,671,074

[45] Date of Patent: Jun. 9, 1987

[54] SHELF UNITS FOR REFRIGERATORS

[75] Inventors: Benjamin F. Gostelow, Warrington; Thomas R. Buick, Cranfield; William B. Hart, Ipswich; Paul N. Gale, Warrington; Trevor L. Carr, Frodsham; Richard C. Dibling, Walden; Philip Albon, Warrington, all of England

[73] Assignee: T.I. Domestic Appliances Limited, London, England

[21] Appl. No.: 847,296

[22] Filed: Apr. 1, 1986

[30] Foreign Application Priority Data

Apr. 3, 1985 [GB] United Kingdom ..... 8508732

[51] Int. Cl.[4] ..... F25D 17/04

[52] U.S. Cl. ..... 62/186; 62/408; 62/440

[58] Field of Search ..... 62/440, 408, 186

[56] References Cited

U.S. PATENT DOCUMENTS

| | | | |
|---|---|---|---|
| 3,027,732 | 4/1962 | Mann et al. | 62/408 X |
| 3,050,956 | 8/1962 | Mann et al. | 62/408 X |
| 3,063,256 | 11/1962 | Lamb | 62/408 X |
| 3,093,981 | 6/1963 | O'Grady | 62/408 |
| 3,364,694 | 1/1968 | Cohen et al. | 62/408 X |
| 3,403,533 | 10/1968 | Bollenbacher | 62/408 |
| 4,488,412 | 12/1984 | Weaver et al. | 62/408 X |

*Primary Examiner*—Lloyd L. King

*Attorney, Agent, or Firm*—Mason, Fenwick & Lawrence

[57] ABSTRACT

A shelf unit (3, FIG. 1) for a refrigerator cabinet includes an air flow passageway (6) connectible to a duct (1) located at the rear of the refrigerator. The flow of air through the passageway (6) is regulated by a flap whose movement is controlled by a thermostat (9) also mounted upon the shelf. The shelf unit, when in position in a refrigerator, enables a user to preset the temperature of the zone in the refrigerator cabinet beneath the unit.

1 Claim, 3 Drawing Figures

SHELF UNITS FOR REFRIGERATORS

This invention relates to shelf units for refrigerators and has particular but not exclusive reference to shelf units for domestic refrigerators.

Conventionally, domestic refrigerators comprise a cabinet whose interior is refrigerated. In some cases, the evaporator of the refrigerator, located within the cabinet, is formed to provide a space maintained at a substantially lower temperature than the remainder of the interior of the cabinet. Refrigerators comprising a separate so-called 'freezer' cabinet are also known, the freezer cabinet being maintained at a substantially lower temperature than the refrigerated cabinet itself.

In such refrigerators, the user is able to control the temperature of the entire cabinet interior only and this is not entirely satisfactory.

It has also been proposed to refrigerate the interior of the cabinet by circulating refrigerated air therethrough. Again, however, the user has limited control only over the cabinet temperature.

It is an object of the present invention to provide a shelf unit for a refrigerator that enables a user to divide a refrigerated cabinet into different zones and to control the temperature in at least one of those zones.

According to the present invention, a refrigerator shelf unit comprises a non-perforate sheet like member adapted for connection to a flow of refrigerated air and means for regulating the rate of flow of air.

The shelf unit may include an air passageway adapted at one end for connection to the flow of refrigerated air and being open at the other end, preferably beneath the shelf.

The shelf unit may also carry a second air passageway adapted at one end for connection to the flow of refrigerated air and being open at the other end, preferably beneath the shelf.

The regulating means may regulate the air flow through the or one of the passageways.

The regulating means may comprise an obturator positioned to vary the transverse cross-section of the passageway.

The obturator may be a pivotally mounted flap.

The regulating means may include a thermostat which may be presettable.

Figure 1:
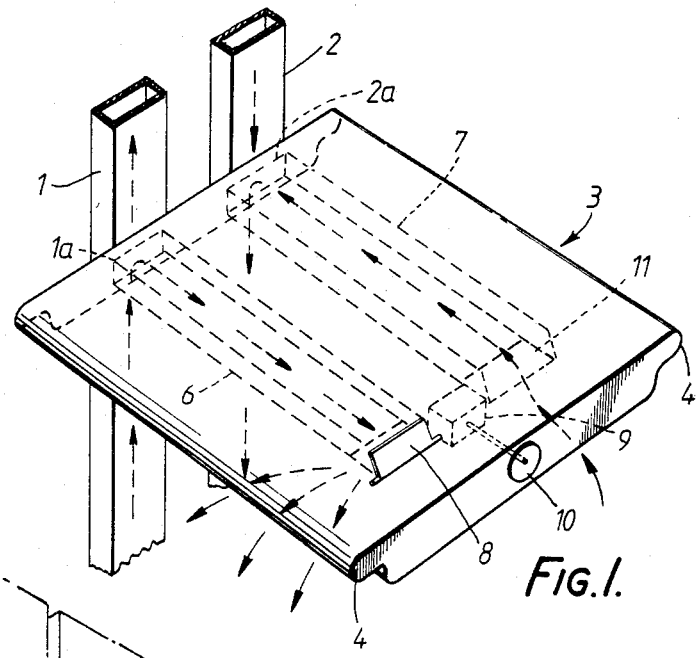
Figure 2:
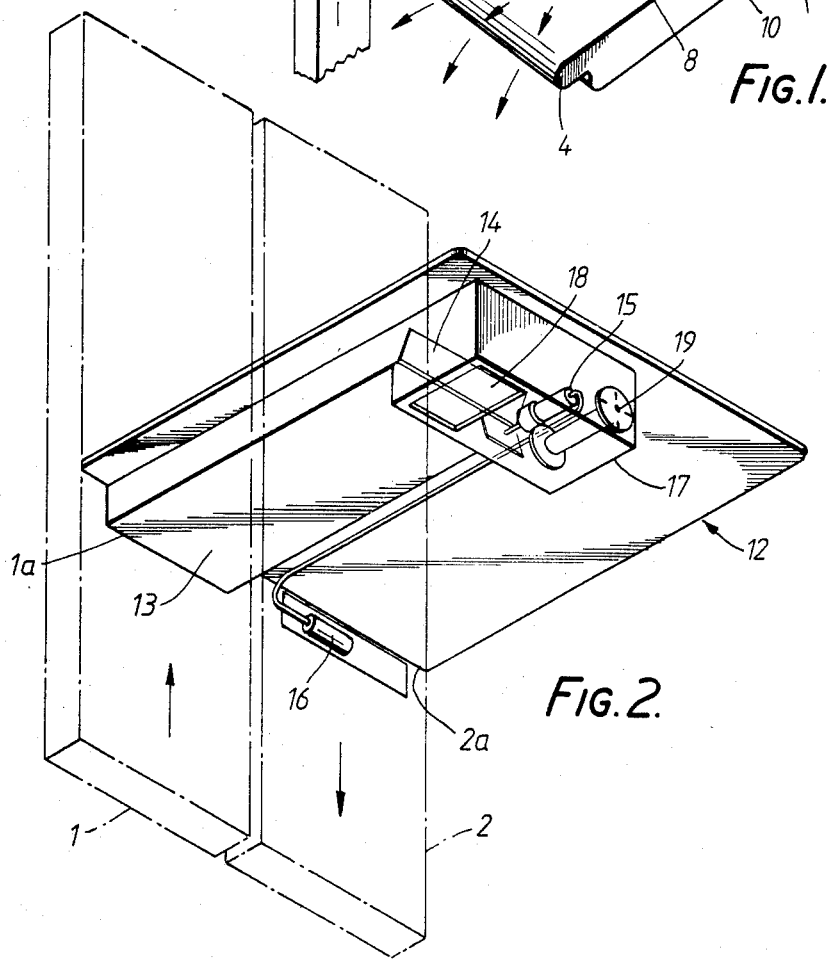
Figure 3:
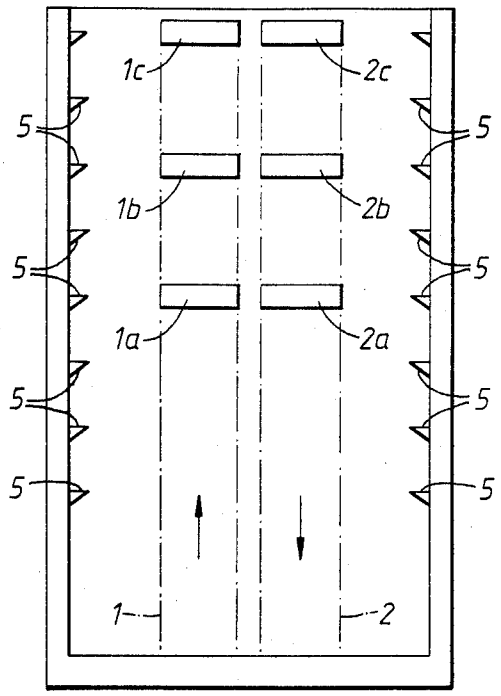

By way of example only, embodiments of the inveniton will now be described in greater detail with reference to the accompanying drawings of which:

FIGS. 1 and 2 are schematic perspective views of different embodiments and, FIG. 3 is an explanatory diagram.

FIG. 1 is a schematic perspective view of a first embodiment of the invention and shows also refrigerated air supply and return ducts 1 and 2 incorporated into the rear wall of the refrigerator cabinet. The air supply and return ducts are connected at their lower ends to supply and return apertures in a refrigerating unit normally located at the base of the refrigerator and from and to which refrigerated air is circulated.

The ducts 1, 2 have apertures in them at different vertical heights as will be made clearer below and FIG. 1 shows two such apertures 1*a* and 2*a*.

The shelf 3 shown in FIG. 1 has side projections 4 by means of which it rests on shelf supports 5 (FIG. 3). The remainder of the shelf is of greater thickness than the side projections and accommodates air flow passageways 6, 7 lying along the front-to-back dimension of the shelf. The passageways terminate, at their rear ends, in or adjacent the rear face of the shelf in fittings which align with apertures in the ducts 1, 2. Such fittings may comprise short extensions or couplers which "plug" into the duct apertures.

At its forward or front end which opens downwardly as seen in FIG. 1 beneath the shelf, passageway 6 is fitted with an obturator in the form of a closure flap 8 pivotally mounted on the shelf in a manner enabling it to close the passageway to an extent determined by the setting of a thermostat shown as block 9 and having a temperature responsive element exposed to the air temperature In the zone below the shelf 3. The temperature responsive element is not shown in FIG. 1. The temperature setting of the thermostat is controlled by a knob 10 located at the front of the shelf. It is thus possible to set the thermostat to control, to a required value, the temperature in the zone below the shelf.

Passageway 7 also terminates at its forward or front end in a downwardly facing opening 11 at or adjacent the front of the shelf and beneath the latter. Such a location of the opening 11 is not essential and it could be placed adjacent the ducts or at some intermediate position.

In use, refrigerated secondary coolant air leaving duct 1 via aperture 1*a* enters passageway 6 and flows into the zone beneath the shelf. The rate of flow of coolant air through passageway 6 is regulated by the position of the flap 8 in response to temperature changes in the zone sensed by the thermally responsive element of the thermostat.

The zone is maintained at the preset temperature by the inflowing coolant air which circulates through the zone and leaves it via opening 11, passageway 7 and aperture 2*a* to enter duct 2. The air flow is shown in FIG. 1 by the arrows.

A second form of shelf is shown in schematic perspective view in FIG. 2. The shelf 12 is of sheet form whose lateral edges rest on the supports 5.

Beneath the shelf and to one side thereof is a passageway 13 that terminates at its inner or rear end in a fitting or coupler that plugs into aperture 1*a* in the duct 1. Air flow through the passageway 13 is controlled by an obturator in the form of a pivotally mounted flap 14 coupled to an actuator 15 forming part of a presettable thermostat whose thermally responsive member shown in FIG. 2 as a phial 16 is exposed to the temperature of air flowing through aperture 2*a* in duct 2.

The actuator 15 and other parts of the thermstat are located in a housing 17 positioned beneath the shelf 12 at the forward or front end of the passageway 13. Secondary coolant air from passageway 13 flows into the housing and leaves via an opening 18 in the bottom wall thereof. Located externally of the housing 17 on the front wall thereof so as to be easily accessible to a user is a control knob 19 by means of which the user can preset the temperature required in the zone beneath the shelf 12.

As can be seen from FIG. 1, opening 2*a* is left substantially unobstructed by the shelf.

In use, refrigerated air leaves duct 1 via aperture 1*a*, enters passageway 13 and flows at a rate controlled by flap 14 into the zone beneath the shelf. The air circulates through the zone and leaves via aperture 2*a*.

It will be appreciated that with the shelf shown in FIG. 2, it is not essential to employ apertures in the ducts 1 and 2 at the same vertical level. Aperture 2*a* could be located at some other level below that of aperture 1*a*.

In addition, the thermally responsive element 16 could be positioned at some other location in the zone.

FIG. 3 is a schematic front elevation of a refrigerated cabinet, the side walls of which incorporate the shelf supports 5 referred to above.

The ducts 1, 2 are incorporated into the back wall of the cabinet and have pairs of apertures 1*a*, 2*a*; 1*b*, 2*b*: 1*c*, 2*c* in them giving access to the interior of the cabinet at different vertical levels. As can be seen, the individual outlets of a pair are at the same vertical height.

The interior of the cabinet can now be divided into two or more zones by means of shelves such as that shown in FIG. 1 or FIG. 2 and which rest upon the shelf supports 5 at the levels of the pairs of openings. Each shelf is a non-perforate structure that effectively prevents circulation of air between the zones.

The temperature in each zone is controlled by the thermostat responsive to the air temperature in the zone and which controls the flow of refrigerated air into the zone. The temperature can be preset by operation of the thermostat.

The shelves are, of course, additional to the conventional shelves and may themselves be used to support food etc. to be refrigerated.

The apertures are all fitted with closures which are automatically displaced to open the aperture when a shelf is "plugged in".

It will be understood that the rate of flow of air into the zone beneath the shelf may, alternatively, be regulated by means associated with the passageway 7 in the embodiment described above with reference to FIG. 1 or the aperture 2*a* in the embodiment described above with reference to FIG. 2.

Further details of the refrigerator itself are to be found in U.K. Patent Application No. 85.08732, the contents of which are hereby incorporated by reference.

The shelf unit may be fabricated from any suitable material. Preferably, however, there is used a high strength inorganic material based on hydraulic cement with a small amount of organic rheological aid. The material and its production is described in more detail in European Patent Applications Nos. 80.301909.9 (0 021 682) and 81.301228.3 (0 038 126).

We claim:

1. A removable shelf unit for a refrigerator, the shelf unit comprising (a) a non-perforate shelf member having a front edge and a rear edge, (b) an open-ended passageway forming part of the shelf unit and having one end at the rear edge and extending towards the front edge, (c) an obturator carried by the shelf for controlling the air flow through the air passageway, (d) an adjustable thermostat carried by the shelf and positioned to be responsive to air temperature below the shelf, and (e) the thermostat being connected to the obturator to effect control over air flow through the air passageway.

* * * * *